US009964268B2

(12) United States Patent
Balten et al.

(10) Patent No.: US 9,964,268 B2
(45) Date of Patent: May 8, 2018

(54) LED EXTERIOR AND STREET LAMPS

(71) Applicant: Phoenix Mecano Digital Elektronik GmbH, Wutha-Farnroda (DE)

(72) Inventors: Andreas Balten, Paderborn (DE); Christian Bischof, Lemgo (DE); Detlev Mueller, Einbeck (DE); Olaf Sausemuth, Sondershausen (DE); Hans-Georg Stumborg, Berlin (DE)

(73) Assignee: Phoenix Mecano Digital Elektronik GmbH, Wutha-Farnroda (DE)

( * ) Notice: Subject to any disclaimer, the term of this patent is extended or adjusted under 35 U.S.C. 154(b) by 0 days. days.

(21) Appl. No.: 15/554,127

(22) PCT Filed: Feb. 24, 2016

(86) PCT No.: PCT/DE2016/000086

§ 371 (c)(1),
(2) Date: Aug. 28, 2017

(87) PCT Pub. No.: WO2015/141906

PCT Pub. Date: Sep. 15, 2016

(65) Prior Publication Data

US 2018/0038564 A1 Feb. 8, 2018

(30) Foreign Application Priority Data

Mar. 10, 2015 (DE) ..... 10 2015 003 114

(51) Int. Cl.

| | |
|---|---|
| ***F21S 4/00*** | (2016.01) |
| ***F21V 21/00*** | (2006.01) |
| ***F21S 8/08*** | (2006.01) |
| ***F21V 15/01*** | (2006.01) |
| ***F21V 31/00*** | (2006.01) |
| ***F21V 29/70*** | (2015.01) |
| *F21Y 115/10* | (2016.01) |
| *F21W 131/103* | (2006.01) |

(52) U.S. Cl.

CPC ..... *F21S 8/086* (2013.01); *F21V 15/01* (2013.01); *F21V 29/70* (2015.01); *F21V 31/005* (2013.01); *F21W 2131/103* (2013.01); *F21Y 2115/10* (2016.08)

(58) Field of Classification Search

USPC ..... 362/249.02

See application file for complete search history.

(56) References Cited

U.S. PATENT DOCUMENTS

| | | | |
|---|---|---|---|
| 2,924,436 | A | 2/1960 | Baran |
| 2009/0251898 | A1 | 10/2009 | Kinnune et al. |

(Continued)

FOREIGN PATENT DOCUMENTS

| | | | |
|---|---|---|---|
| DE | 202006010949 | U1 | 9/2006 |
| DE | 202009004191 | U1 | 6/2009 |
| EP | 2189709 | A1 | 5/2010 |

*Primary Examiner* — Rafferty Kelly

(74) *Attorney, Agent, or Firm* — Norris McLaughlin & Marcus, P.A.

(57) ABSTRACT

An LED exterior and street lamp (luminaire) is provided with an LED operating chamber and a functional chamber each hermetically sealed and interconnected to each other in a thermally-isolated manner at their narrow end faces, the chambers being surrounded by a cooling surface which can be replaced externally on the housing of the chambers and can be adapted in terms of surface area.

11 Claims, 4 Drawing Sheets

(56) References Cited

U.S. PATENT DOCUMENTS

| | | | | |
|---|---|---|---|---|
| 2010/0315252 | A1 | 12/2010 | Desphande et al. | |
| 2012/0262917 | A1 | 10/2012 | Courcelle | |
| 2013/0148360 | A1 | 6/2013 | Jeon et al. | |
| 2014/0049961 | A1 | 2/2014 | Wilcox et al. | |
| 2014/0254156 | A1* | 9/2014 | Hsu | F21V 27/02 362/249.1 |

* cited by examiner

LED EXTERIOR AND STREET LAMPS

BACKGROUND OF THE INVENTION

The invention relates to LED exterior and street luminaires, which have a uniform and identical basic composition that can be used for a variety of power ratings and are employed for different lighting purposes.

According to the known prior art, the problem with LED exterior and street luminaires is that the use of identical design lines for different power ratings still necessitates different housings, and heat sinks that, internally, are separately adapted to each type of luminaire, for the LED assemblies. By way of example, refer to the luminaire generation made by Aton Lichttechnik (data sheets: Classic Maxi ECO, Classic Standard ECO and Classic Compact ECO). The situation is similar with other manufacturers.

Such an adaptation of particular luminaires to specific conditions, or lighting requirements, however, entails considerable manufacturing, design and stock-keeping complexity.

An LED lighting device is furthermore known from DE 20 2009 004 191 U1. The luminaire housing is made of continuous aluminum profiles, which only for reasons related to manufacturing costs is divided into three parts that have a separation on the longitudinal side (two lateral lamp shells and one central lamp shell). The profiles, serving as the housing, are thus designed continuously and in one piece across the two functional spaces, such that no thermal separation is ensured between the two functional spaces, which are the lamp shell for the LED luminous elements and the lamp shell for the operating devices and terminal space. Heat can thus flow unimpaired between the two functional spaces via the profile material. Thermal separation by way of the housing is thus not ensured, despite the central separating wall in the overall receiving space of the profile housing described. A further disadvantage is the generally undesirable exterior cooling fins, which present a decrease in the self-cleaning effect, such that the heat dissipation efficiency is decreased over time as a result of soiling. The described solution furthermore has the disadvantage that only a side-mounted installation on poles is possible, and no adjustment option whatsoever exists for upward or downward inclination of the luminaire head. Installation on pole tops is not possible at all. As a result, with this solution, lighting-related requirements with regard to the particular illumination task can be achieved only conditionally.

Solutions are also known from U.S. Pat. No. 2,924,436 A and DE 20 2006 010 949 U1, which describe adaptable and replaceable cooling plates or heat sinks for heat transfer to the ambient air.

The disadvantage of U.S. Pat. No. 2,924,436 A is that a solution for ceiling mounting is introduced, the design and technology of which are not suitable for exterior and street luminaires. In particular, there is a need for heat dissipation, and the cooling plates can be cooled by way of water lines.

DE 20 2006 010 949 U1 describes a different embodiment of heat sinks on the outside of a street luminaire, for example. The key here is essentially a plurality of cooling fins, which can be disposed in a variety of manners or detachably connected to a frame, serving as part of a luminaire housing, and in general are disposed on the upper face of a frame. The main drawback of this solution is the embodiment of the cooling elements in the form of cooling fins, and the arrangement thereof on the upper face of the luminaire. The design of the luminaire is adversely affected by the required height of the fins and the arrangement thereof on the upper face, and by the aforementioned problem of a limited self-cleaning effect.

The document US 2013/0148360 A1 is also known, which describes an LED lighting device comprising solutions for improving waterproofing performance. An essentially one-piece housing is described, having water drain contours on the upper face. Despite an apparent internal subdivision of the spaces for the LED assembly and for the assembly for the operating device and terminal connection components using a separating wall, no effective thermal separation exists to suppress the heat flow within the housing between these two spaces. Additionally, the designs and the geometries of described housings are so narrowly defined that a modified outside geometry is not possible while keeping the system technology the same. Furthermore, due to the fin-like surface structures, disadvantages again arise in terms of the self-cleaning effect, which practical users value highly. Moreover, once again, only pole-side mounting is possible, without the option of adjusting the angle of inclination.

Furthermore, document US 2014/0049961 A1 is known, which describes a further street luminaire for exclusive pole-side mounting. Optimal heat dissipation for the LED system is to be achieved here by maximal contact of the LED operating space in the front, rear and lateral regions with the circulating ambient air. Paragraph [0027], in particular, describes various embodiments of the configuration of the housing frame, which substantially thermally separates the LED module, together with the casing thereof, spaced at various distances from the portion of the housing for the LED drivers and wiring, so as to create a maximum surface for the ambient air flow.

The disadvantage here is the complicated overall construction of the luminaire housing at hand, which is provided with a large number of apertures and fins, which thus departs to a high degree from the object of the solution claimed in the present invention of implementing a single-piece luminaire head having a uniform design appearance. This solution, once again, has the disadvantage that the surfaces comprising high fins soil over time, and that the outside geometry is inalterably established by the housing design.

Furthermore, the known document US 2012/0262917 A1 describes a street luminaire comprising a single-piece luminaire housing having sections for the LED system and the operating device and terminal space (see paragraph [0062] therein) which are spatially separated on the inside. The outwardly extending fins serving as cooling elements are integrally formed with the luminaire housing (see paragraph [0047] therein). The LED module, serving as the light source, uses a dedicated optical chamber having its own enclosure, which can be integrated into the provided installation space and, due to the separate design, is independent and replaceable.

SUMMARY OF THE INVENTION

Disadvantages of the prior art compared to the solution claimed in the present invention are the single-piece luminaire housing, which does not suppress the heat transfer from the LED system to the operating device and terminal space, the housing design, which again comprises outside cooling fins, and the design thereof within the meaning of conventional box-type luminaires having a significant height, which considerably deviates from a modern design of current solutions for LED luminaire heads. Furthermore, there is no design freedom in terms of modifying the attachment elements. Additionally, there is the known disadvantage that the luminaire head can only be installed on the pole side.

It is therefore the object of the present invention to create an LED exterior and street luminaire, in which essential assemblies, such as the LED operating space and the space for accommodating further technical functional elements, such as the LED operating device, the AC power connecting terminals and the like, can always be identically implemented, regardless of the power rating of the respective LEDs used. This eliminates the need to produce, and keep in stock, separate housings for different power ratings in a predefinable framework.

The essence of the present invention is that an LED module assembly is accommodated in a separate LED operating space or chamber in a hermetically sealed manner, and that a second functional space or chamber adjoins this space and is used to separately accommodate, in a likewise hermetically sealed manner, AC power operating devices, AC power connecting terminals and other means required for operation, and that the two aforementioned operating and functional spaces are surrounded by a cooling surface which can be replaced externally on the housings of the aforementioned spaces and is adaptable, in terms of the surface area thereof. The housings which form the operating and functional spaces are frequently referred to herein as the spaces themselves. Due to this design of the LED exterior and street luminaire according to the invention, in which a defined separation between the operating and functional spaces is provided by way of separate hermetic sealing, wherein the two aforementioned spaces can be connected from the outside by a cooling surface that is variably adaptable in terms of the size of the surface area, it is possible to accommodate LED module assemblies of a wide variety of power ratings in the aforementioned spaces, and to accommodate, for example, LED operating devices of a wide variety of power ratings and adapted further operating means in the functional space, within the provided design boundaries, using a single design specification for the size of the operating and functional spaces, wherein the adaptation to the corresponding power rating so as to ensure compliance with internal temperatures that are not to be exceeded and ensure the aforementioned spaces is ensured solely by way of the size and the surface-area design of a cooling surface which can be replaced from the outside and is adaptable and which, via tabs, is in close thermal contact with the lateral operating and functional space surface areas, and is connected to these.

BRIEF DESCRIPTION OF THE DRAWINGS

The following exemplary embodiments and figures are provided for a more detailed description of the invention. In the drawings.

DETAILED DESCRIPTION OF THE INVENTION

Figure 1:
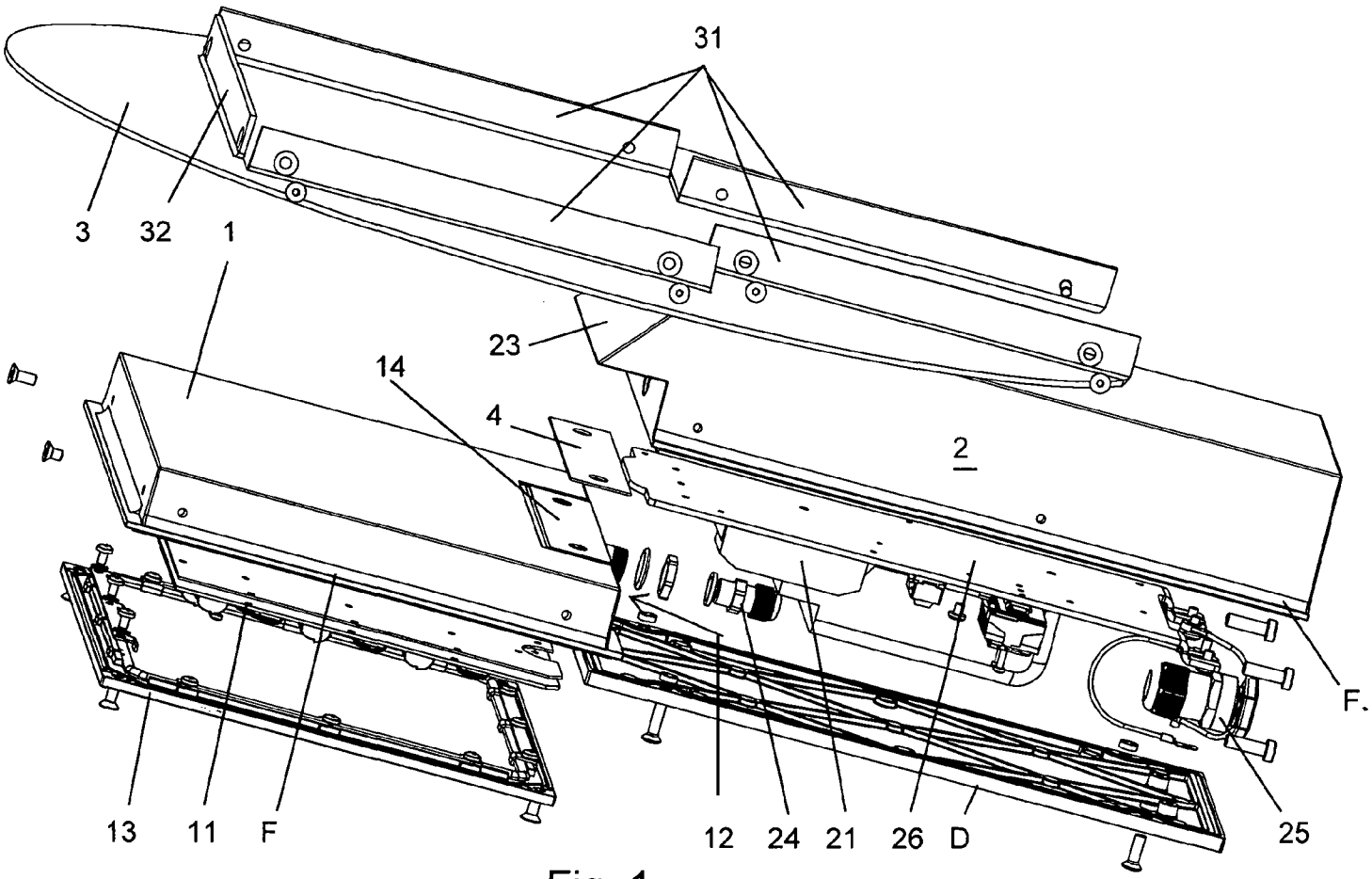
FIG. 1 shows a basic embodiment of the invention in an exploded view.

FIG. 1 shows a basic embodiment of the invention in an exploded view, comprising all essential elements. In the left portion of FIG. 1, housing configured as an LED operating space 1 is apparent, in which an LED module assembly 11 comprising multiple LEDs, which are not denoted in detail, can be introduced, the operating space being hermetically sealable by way of a cover 13, which includes a light emission panel, so that this module part satisfies protection classes IP66 and above. When a hermetically sealed design is described here and hereafter within the scope of the invention, this shall always be understood to mean that the dustproof and waterproof performance of the particular assembly, as defined by the protection class for luminaires used inexterior applications, is specified and adhered to. In the right portion of FIG. 1, the LED operating space 1 is furthermore adjoined by a housing configured as functional space 2, which includes customary assemblies, such as the operating device(s) 21, AC power connecting terminal 22 and the like, and various control modules, which are not denoted or shown in detail, and a pole adapter. All aforementioned assemblies of the functional space 2 are likewise accommodated in a hermetically sealed manner, as defined above, within the space 2, so that this space also satisfies protection classes IP66 and higher when the functional space is fully assembled.

Figure 1A:
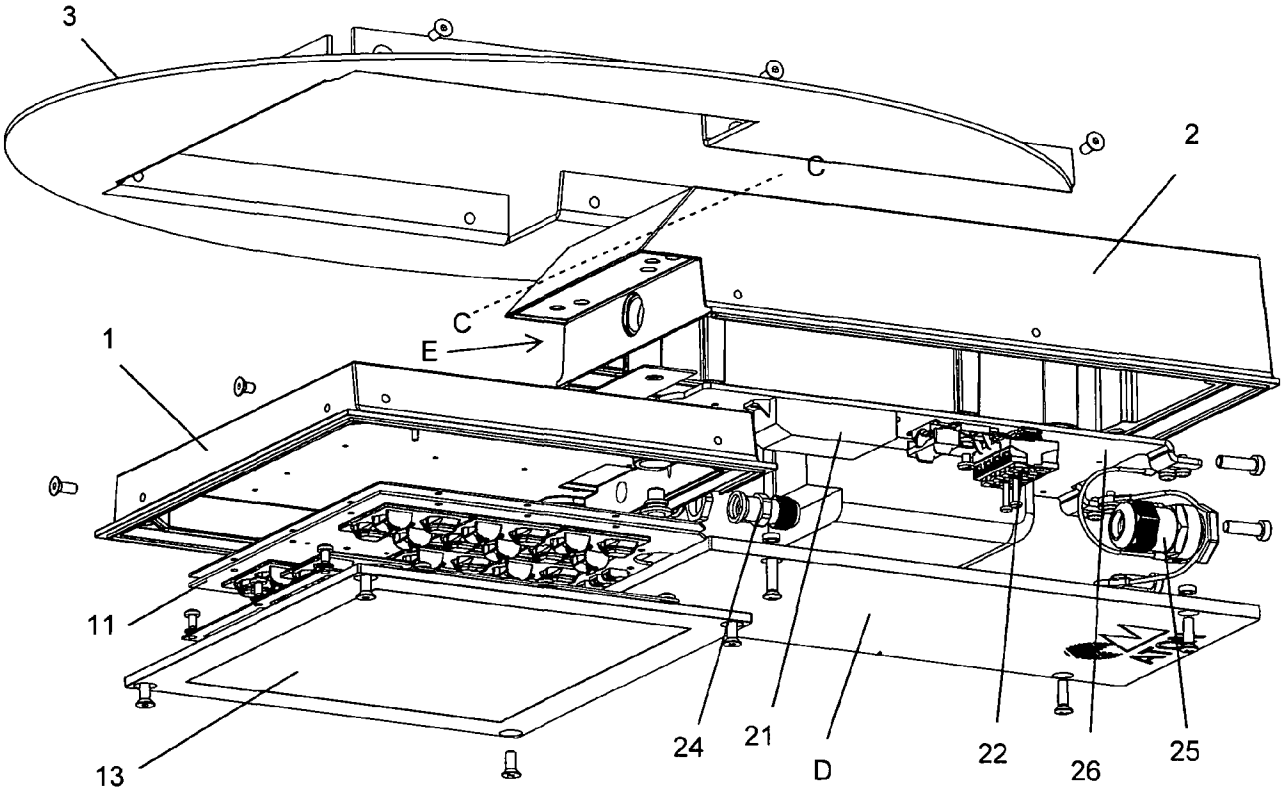
FIG. 1*a* shows the embodiment according to FIG. 1 in a view from beneath.

In further details, it is apparent from FIGS. 1 and 1*a* that the necessary functional assemblies (such as 21, 22) in the functional space 2 are attached on a mounting plate 26, and can each be secured in the interior of the functional space 2 in an identical manner by way of screw bosses, which are not shown, regardless of the specific embodiment of the functional assemblies in the functional space 2, each of which being adapted in keeping with the power rating of the LED module assemblies 11 installed in the LED operating space 1. In the fully assembled state in which delivery takes place, this functional space is hermetically sealed by way of a cover D.

It is furthermore apparent from FIG. 1 that a fold (i.e., flange) F is provided peripherally on the lower edge of each of the LED operating and functional spaces 1, 2, which in the assembled state are located in one plane. This fold F forms the stop and the final mounting position for the cooling surface 3 placed thereon, which in the example of FIG. 1 is provided with five tabs 31, 32, which can be screwed to the LED operating and functional spaces 1, 2 by way of provided boreholes and ensure the required thermal transfer from the respective spaces to the cooling surface 3.

The mechanical connection of the aforementioned cooling surface 3 by way of the tabs 31 is likewise identical for all possible power ratings of the LED module assemblies 11 that are used, and only the surface-area size and design of the cooling surface 3 are modified in accordance with the cooling power to be delivered by the same. Since this is an inexpensive assembly that is relatively easy to produce, this feature represents a considerable improvement compared to the known prior art, within the meaning of the object of the present invention.

It is already apparent here that, while the operating and functional spaces 1, 2 are always identically designed, the cooling surface 3 represents a variably configurable design element. In contrast to the completely new design and construction of luminaires cited at the outset, which form part of one design line, but have differing power ratings, this can be achieved here by way of the respective adapted embodiment of only the cooling surface 3.

The configuration of the cooling surface 3 is the crucial factor for the overall aesthetic impression and recognition factor of the luminaires of a design line, and in this way, variety of luminaire designs can be implemented, regardless of the LED operating and functional spaces 1, 2. The outer contours, size, coloring and type of the design embodiment (single- or multi-piece, sheet metal or casting) of the cooling surface can be freely configured, to the extent these can be reconciled with the geometries and mounting options on the operating and functional spaces.

Within the scope of the invention, it must be taken into consideration that the LED module assembly 11 in the LED operating space 1 represents the main heat source. This becomes relevant, in particular, starting with a borderline system rating for the LED module assembly 11, which otherwise would result in excessive heating and thus reduce the service life of the LEDs. If, for example, an LED module assembly is equipped with 36 power LEDs, the LED module assembly supplies approximately 74 W at an LED current of 700 mA, and a system power for the luminaire, on the AC power supply, of approximately 80 W. The resulting lost heat must be dissipated, which is achieved by way of the appropriately designed cooling surface 3 according to the invention. The necessary geometry with respect to the required size of the cooling surface 3 relative to the ambient air can be professionally ascertained in the laboratory within the scope of the first design, and due to the concept according to the invention, flexible cooling surface configurations are possible here.

However, the electrically operated means provided in the functional space, such as, in particular, the LED operating device 21, control units, and the like, also generate a certain amount of lost heat, which must not be exceeded during operation of the luminaire, but which, by itself, is lower than the lost heat generated in the LED operating space 1, and thus is initially easier to dissipate by way of the provided cooling surface. As a result, the design of the cooling surface 3, in terms of the surface area, can be accordingly smaller in the region of the functional space 2.

Another essential feature of the present invention is the fact that the LED operating space 1 is thermally substantially separated from the functional space 2. This is achieved within the scope of the invention in that the LED operating and functional spaces 1, 2, which can each be hermetically sealed, essentially have only indirect thermal contact with one another on two mutually opposing narrow side surfaces, so as to substantially suppress heat conduction from the warmer LED operating space 1 to the functional space 2.

Figure 2:
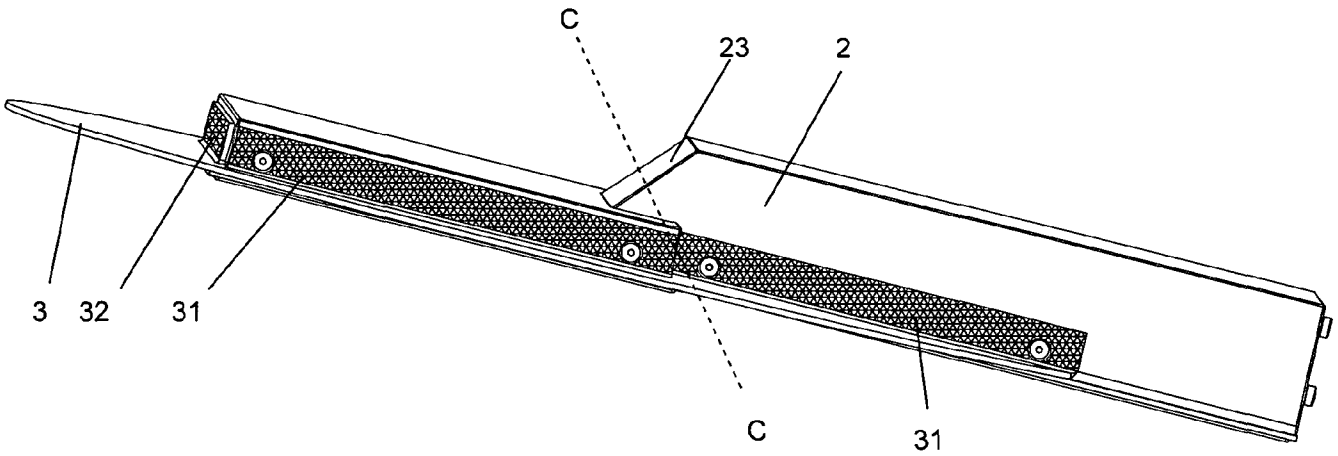
FIG. 2 shows a perspective side view of the operating and functional spaces when assembled, provided with a cooling surface.
Figure 3:
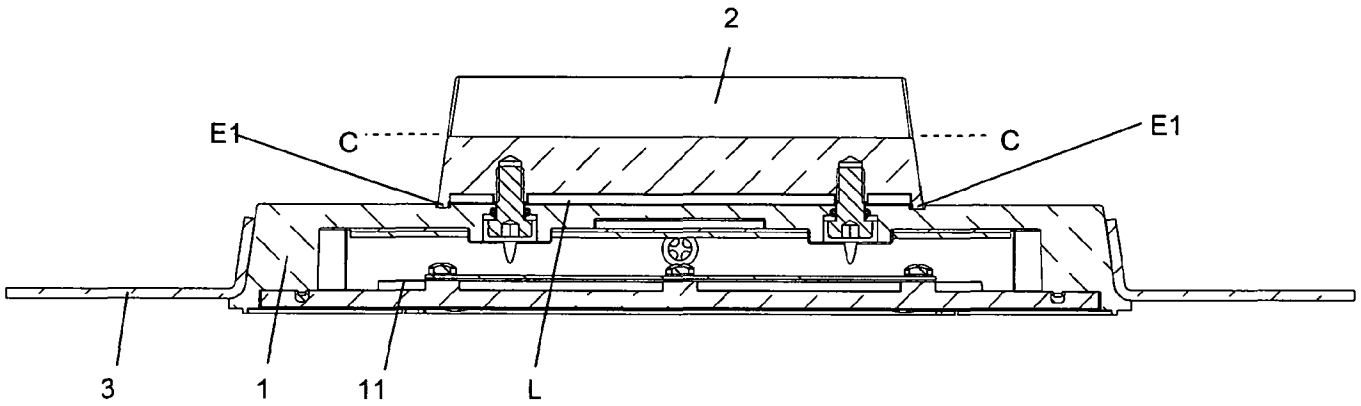
FIG. 3 shows a detailed illustration of a special embodiment of the space between the operating and functional spaces.

In a particularly advantageous embodiment, which FIG. 2 is intended to illustrate in a side view, it is apparent that initially the surface areas of the LED operating and functional spaces 1, 2 making contact with one another are kept preferably small, which in the specific example takes place via a corner region E. In combination with FIG. 1, the surface area which, in principle, can be used for the thermal contact between the two spaces is apparent. In the specific example, this surface area is approximately two times 38 $cm^2$. It is furthermore apparent from FIGS. 1 and 2 that the height of the functional space 2, on the side away from the illumination, has a roof-like shape and is higher than the LED operating space 1, wherein this space projects above the LED operating space 1 in a hood-like manner in the connecting region of the two spaces, and, within the hood region 23, is screwed on the inside to the LED operating space 1 perpendicularly to the longitudinal extension of the functional space 2 (see boreholes in FIG. 1 in the LED operating space 1 beneath the corner region E). The connecting surfaces in the corner region E, formed by the hood-like projection 23, are designed by way of a screw joint in such a way that, when the luminaire is fully assembled, the tensile forces caused by the inherent weight or additional loads resulting from snow, birds and the like are directly absorbed by screws, which are not shown in greater detail here, without having to fear deformation or loosening. Within the scope of the invention, in the assembled state, this corner region E includes another special feature, which is that, when the LED operating and functional spaces 1, 2 are connected, the mutually opposing surface areas are not seated against one another in a planar manner, but rather, at least on the side on which higher heat input will take place from the LED operating space 1, which is to say the roof surface 14 thereof (see FIG. 1*a*), contact will take place only by way of web-like overhangs E1, which are implemented by appropriately configuring the corresponding surface areas of the functional space 2, so that, toward the outside in the assembled state, a visually self-contained shape is created, which in the interior, however, between the two LED operating and functional spaces 1, 2 encloses a space around the aforementioned corner region E that is initially only filled with air, and thus encloses an additional thermal insulator, at least in the above-described region of the roof surface 14. In addition, optionally in order to specify defined coefficients of heat conductivity, this space filled with air can also be filled with a thermal insulating means 4 (such as a thermal insulating panel) that is selectable and predefinable with respect to the heat conductivity and/or, for example in order to increase the mechanical stability and/or reduce the deformability of the spaces 1, 2 joined to one another, this space can be provided with spaced noses, inner webs and/or elevations, which cause a reduction in the actual thermal transfer surface areas compared to planar contact. FIG. 3 serves to provide a better understanding of the above special description and shows a sectional view along a cutting plane C-C indicated in FIG. 1*a* and FIG. 2. It is apparent from FIG. 3 that the functional space 2, in the region projecting above the LED operating space in a hood-like manner, comprises web-like overhangs E1, which engage in grooves (not denoted in detail) in the particular roof surface 14 of the LED operating space 1, and surround an interposed region, which is highly exaggerated here, for the purpose of creating an air space L, which acts as a thermal insulator. It is within the scope of the invention that such web-like overhangs E1 are also present on the narrow stop side 12, which is to say perpendicularly to the section described immediately above, this being the functional space 2; the action of these overhangs, however, is in terms of thermal insulation considerably lower, due to an air space enclosed therein, and thus these can be dispensed with in this section with a view to simplifying manufacturing.

With reference to FIG. 1, it is furthermore apparent that the electrical connection of the LED module assemblies in the LED operating space 1 to the LED operating device 21 takes place by way of a cable feedthrough 24 connecting this to the functional space 2. This cable feedthrough is hermetically sealed against water and dust and comprises a pressure equalization valve, which acts between the LED operating space and functional space. Likewise, the functional space 2 is equipped with a further analogously designed cable feedthrough 25 for the connection to the AC power line, which is likewise equipped with a pressure equalization valve. The function of these pressure equalization valves is to ensure appropriate ventilation of the respective spaces under changing thermal loads (such as when rain sets in, and the like) so as to reduce overpressure or underpressure. The pressure equalization valve in the cable feedthrough 25 functions with respect to the external atmospheric side. This valve is impervious to dust and water. Optionally, the installed membrane can be replaced during maintenance, so that the valve action can be made functional at all times again should soiling occur. The LED operating space 1 is designed as a separate and hermetically sealed space to protect the LED module assembly 11 against corrosion and soiling, as was already mentioned above, which is to say the space is also appropriately hermetically separated from the functional space 2. So as to ensure the same pressure equalization effect for the LED operating space 1 as well, a further pressure equalization valve is provided internally between the LED operating space 1 and the functional space 2 in the cable feedthrough 24. This ensures pressure equalization from the LED operating space 1 into the functional space 2. Due to the considerably smaller volume of the LED operating space 1 in relation to the functional space 2, effectiveness of the pressure equalization is ensured, wherein the effective volumetric flow rate per unit of time of the valve in the cable feedthrough 25 is designed to be greater than that of the valve in the cable feedthrough 24 to the LED operating space 1.

In terms of the special design of the operating space 1, the functional space 2 and the cooling surface 3 with tabs 31, it has proven advantageous to select an aluminum sheet, preferably having a thickness of 2.5 to 3 mm. Due to the manufacturing process selected in the present example, the aforementioned lateral surfaces of the operating and functional spaces have a certain degree of draft angle. The angling of the tabs 31 is to be implemented in keeping with the draft angles. Advantageously, the angle of the tabs 31 can be selected slightly smaller, so that these press lightly with tension against the corresponding opposite lateral surface of the side walls of the operating and functional spaces during installation of the cooling surface 3, and thus ensure close seating and optional thermal contact. This special embodiment, however, does not limit the invention. If the configuration of the aforementioned lateral surfaces and tabs is implemented in a strictly perpendicular manner, this only requires more precise manufacturing for implementing the same heat transfer via the tabs. In the specific example, using only four tabs 31 provided in pairs opposite one another (see FIG. 1), the tabs have a length of 230 mm and 210 mm, and a width of approximately 20 mm, resulting in contact transfer surfaces of 176 $cm^2$.

It was found that it is sufficient to attach each of the tabs 31 in the example to the respective space by way of two screw joints. Contact materials such as heat conductive pads or heat conductive paste are not required as a result of the described manner of the connection of the cooling surface 3, but may be used if desired.

So as to further optimize the cooling action, a fifth tab 32 is provided on the end face at the LED operating space 1 in the specific example. This yields even more optimal heat flow from the LED operating space to the cooling surface 3, and more particularly, exactly where the greatest lost heat is produced during operation.

The following experimentally obtained measured values, at an ambient temperature of 25° C., shall be used to track the influence of the measures according to the invention in detail.

The ambient operating temperature of a commercially available LED operating device is approximately 55° C.

The temperature reached with an LED module assembly with a system rating of 80 W (without cooling surface 3) in the LED operating space is 63° C., which clearly exceeds the manufacturer's specification for the guaranteed service life. Solely attaching the cooling surface 3 by way of only four tabs 31 already lowers the temperatures in the LED operating space beneath the critical value to be adhered to, which in the example is 53° C. (for a total surface area of the cooling surface 3 of 17 $dm^2$). Providing the above-described further fifth tab 32 brings about a further reduction in temperature in the LED operating space 1 of 4 to 5 K. The thermal separation provided according to the invention between the LED operating space 1 and the functional space 2 causes the temperature in the functional space 2 to be reduced by at least 5 K, under the same conditions as described above, and thus ensures that the specified maximum ambient operating temperature for the operating device (usually 55° C.) is not exceeded. This shows the effectiveness of the present measures, and as a result of the relatively low temperatures during operation of the luminaire, the service lives of the LED module assembly and the operating devices is considerably extended. If a higher power rating is used for the LED module assembly 11, all that is needed is to increase the surface area of the cooling surface 3, while the configurations of the LED operating space 1 and of the functional space 2 can otherwise be kept identical. It was furthermore found that, with every increase in the power rating by 10 W, an increase in the cooling surface 3 by approximately 18% represents an effective measure to continue to ensure sufficient cooling action.

In all described instances, the upper and lower faces of the cooling surface 3 are planar and implemented without additional cooling fins or heat sinks, so that these are not only extremely inexpensive to manufacture (compared to heat sinks of the known prior art), but unnecessary soiling and high snow loads are also prevented. Another significant advantage compared to the known prior art is that the identical shape and size can always be used to configure the LED operating space 1 and the functional space 2 for an entire luminaire line having differing power ratings.

The design advantages and degrees of freedom for configuring the cooling surface 3 are diverse, and as a result, it is possible to respond very quickly to customer requirements solely with a modified design of the cooling surface 3 (round, oval, angular, colored and the like), and in this way, different design lines can be implemented easily and quickly.

The assembled LED exterior and street luminaire equipped with all above-described assemblies can be easily mounted at the installation site by opening the cover D provided on the road-side lower face of the functional space 2, with the installer only having to implement the electrical connection to the AC power supply line via the cable feedthrough 25 and the mechanical connection to the pole, using attachment means not shown here. Thereafter, the cover D, which comprises peripheral ribbing and sealing compound disposed therein, is merely screwed on again. For the purpose of implementing the required high waterproof and dustproof performance in keeping with at least IP66, the cover is securely screwed to the base body of the functional space 2, preferably by way of at least four screws. To provide captive securing during opening, this cover is preferably connected to the base body of the functional space 2 by way of a retaining cable.

On the light emission side, the LED operating space 1 is likewise provided with a hermetically sealed cover 13, which, however, can be detached for installation purposes and which is made of a torsion-resistant metal frame, having a light emission panel made of highly transparent plastic material (such as PMMA) or mineral shatterproof glass mounted therein in a sealed manner. For the direct installation on the connecting pole, however, this LED operating space, which is already hermetically sealed at the factory, remains closed, and the installer must only open the aforementioned cover D on the functional space 2.

In addition to the previously described economic advantages of the present invention, considerable technical advantages are also obtained in that, for example, using the proposed solution, it will be possible to determine, not only the design, but also the basic size of the luminaire, without making any modifications to the actual "technology."

Especially in the case of modern LED systems, the option exists to generate very different system or lighting ratings, using identically constructed technology.

For luminaires having higher lighting ratings, there is also the need for a higher light spot installation. When a geometry that is aesthetically expedient for considerably shorter pole heights is used here, this geometry may appear unsuitable for higher poles, and vice versa. This disadvantage of the prior art can be eliminated, to a large extent, by simply replacing the cooling surface 3. It is also possible, for example, to use a larger cooling surface that, technologically, is in fact not needed if required for aesthetic considerations.

All features discernible from the description, the exemplary embodiments, and the following drawings can be essential to the invention to the invention, both individually and in any arbitrary combination with each other.

The invention claimed is:

1. An LED exterior or street luminaire configured for direct connection to an exterior pole or a home or building connection cable, comprising a hermetically sealed first housing configured to form an operating space for an LED module assembly, the LED module assembly being received in the first housing, a hermetically sealed second housing configured to form a functional space for functional devices, the functional devices being received in the second housing and comprising AC power operating devices and AC power connecting terminals, wherein the two housings are mechanically connected to one another at an end wall of the first housing, the end wall being of sufficiently smaller area than lateral walls of the first housing so as to thermally substantially decouple the operating space from the functional space, respective outwardly extending flanges are formed around a periphery or at least on opposed lateral walls of the housings adjacent lower extremities of the walls of the housings, and a planar web of heat conductive material forming a cooling surface of predetermined area rests on the flanges and is detachably connected to and in thermal communication with the lateral walls or the lateral walls and end walls of the housings by way of tabs and is configured to be interchangeable with other like constructed cooling surfaces.

2. The LED luminaire according to claim 1, wherein an end portion of the second housing overlies an end portion of a roof of the first housing and the second housing is provided with downwardly extending webs which engage the end portion of the roof of the first housing thereby to provide a space between the end portion of the second housing and the end portion of the roof of the first housing which the end portion of the second housing overlies which space further thermally substantially decouples the operating space from the functional space.

3. The LED luminaire according to claim 2, further comprising insulating material in the space.

4. The LED luminaire according to claim 1, wherein the first and second housings each have a respective roof, the roof of the second housing is higher than the roof of the first housing, the functional space defined by the second housing partially overlies the operating space defined by the first housing and at a portion of the second housing overlying the first housing the second housing is fastened to the first housing by screws extending into the operating space and oriented perpendicularly to a length of the functional space.

5. The LED luminaire according to claim 1, further comprising a first sealed cable feedthrough for an AC power supply line, the first sealed cable feedthrough communicating between the operating space and the functional space and comprising a first pressure equalization valve.

6. The LED luminaire according to claim 5, further comprising a second sealed cable feedthrough for an AC power supply line, the second sealed cable feedthrough communicating between the ambient and the functional space and comprising a second pressure equalization valve.

7. The LED luminaire according to claim 6, wherein the first and second pressure equalization valves are so configured that the effective volumetric flow rate per unit time through the second pressure equalization valve is greater than that of the first pressure equalization valve.

8. The LED luminaire according to claim 1, wherein the lateral walls and the end walls of the housings flare outwardly at a predetermined angle so that width and length of each of the housings is greater at a bottom thereof than at a roof thereof and the tabs are bendable and are preformed with an angle of inclination sufficiently smaller than the angle at which the walls of the housings flare outwardly so that when the planar web of heat conductive material is assembled with the housings, the tabs bend to conform to the angle at which the walls flare outwardly so as to press firmly against surfaces of the walls of the housings in a planar manner.

9. The LED luminaire according to claim 8, wherein surface areas of the lateral walls of the housings are in engagement with the tabs.

10. The LED luminaire according to claim 8, wherein surfaces of at least three mutually adjoining walls of the first housing are in engagement with the tabs.

11. The LED luminaire according to claim 1, wherein the first housing comprises, at a bottom thereof, a hermetically sealed cover configured for passing therethrough of illumination from the LED module, wherein the cover is detachable from the rest of the first housing.

* * * * *